United States Patent [19]

Kewin

[11] Patent Number: 4,875,636

[45] Date of Patent: Oct. 24, 1989

[54] NON-RETURNABLE NEWSPRINT CARRIER SYSTEM

[75] Inventor: Daniel D. Kewin, Brantford, Canada

[73] Assignee: Sonoco Products Company, Hartsville, S.C.

[21] Appl. No.: 119,519

[22] Filed: Nov. 12, 1987

[51] Int. Cl.[4] ..... B65D 85/67

[52] U.S. Cl. ..... 242/68.6; 242/68.5

[58] Field of Search ..... 242/68.5, 68.6, 68.4, 242/68.3

[56] References Cited

U.S. PATENT DOCUMENTS

| | | | |
|---|---|---|---|
| Re. 30,168 | 12/1979 | Mason . | |
| 152,321 | 6/1874 | Beck . | |
| 888,860 | 2/1908 | Burns . | |
| 911,006 | 1/1909 | Gately | 242/68.6 |
| 1,358,531 | 11/1920 | Dodge . | |
| 1,397,143 | 11/1921 | Parker . | |
| 1,459,241 | 6/1923 | Norstrom . | |
| 1,602,166 | 10/1926 | Parker . | |
| 2,266,494 | 12/1941 | Adams . | |
| 2,336,161 | 12/1943 | Blanchet . | |
| 2,760,732 | 8/1956 | Bebie . | |
| 2,985,292 | 5/1961 | Beaudoin . | |
| 2,988,032 | 6/1961 | Voissem . | |
| 3,113,743 | 12/1963 | Hay . | |
| 3,355,121 | 11/1967 | Wright . | |
| 3,432,112 | 3/1969 | Hardy . | |
| 3,454,155 | 7/1969 | Voissem et al. . | |
| 3,567,146 | 3/1971 | Arenson . | |
| 3,615,063 | 10/1971 | Bates . | |
| 3,627,220 | 12/1971 | Vogel . | |
| 3,840,194 | 10/1974 | Vetter . | |
| 3,865,326 | 2/1975 | Beaudoin . | |
| 3,990,649 | 11/1976 | Adams . | |
| 3,990,690 | 11/1976 | Lick . | |
| 3,993,317 | 11/1976 | Flagg . | |
| 4,015,711 | 4/1977 | Mason . | |
| 4,460,087 | 7/1984 | DeMarco et al. . | |
| 4,513,864 | 4/1985 | Liebel . | |
| 4,547,417 | 10/1985 | Demarco et al. | 242/68.6 X |

*Primary Examiner*—Stuart S. Levy
*Assistant Examiner*—Steven M. duBois
*Attorney, Agent, or Firm*—Bell, Seltzer, Park & Gibson

[57] ABSTRACT

A non-returnable newsprint carrier system is provided which is adapted for winding or newsprint, shipping and storing of newsprint and mounting in reels of offset printing presses on stub shafts, and which is characterized by eliminating the need for a return to the newsprint manufacturer, increasing core crush resistance during shipping and storing, and reducing roll vibration during unwinding in the printing press. The system comprises a tubular core without metal end caps thereon and defining inside surfaces at opposite ends for receiving therewithin the reel stub shafts of the offset printing press. Core plugs are provided for being inserted into the ends of the tubular core to prevent damage to the end portions of the tubular core and to the newsprint roll. Each of the core plugs comprise a solid body without holes or grooves therein and formed of crush resistant material. The inside surfaces of the opposite end portions of the tubular core and the outside surfaces of the core plugs have substantially the same non-cylindrical configuration, profile and dimensions as the portion of the outside surfaces of the reel stub shafts so that the tubular core will have a full profile fit in surface-to-surface contact over substantially the entire surface area of the reel stub shafts and the core plugs. The core plugs have an outside lip area for suitable engagement or gripping to remove the core plugs from the tubular core.

12 Claims, 1 Drawing Sheet

NON-RETURNABLE NEWSPRINT CARRIER SYSTEM

FIELD OF THE INVENTION

This invention relates to a non-returnable newsprint carrier system adapted for winding of newsprint, shipping and storing of newsprint and mounting in reels of offset printing presses on stub shafts having a predetermined outside configuration and profile for unwinding of newsprint. The non-returnable newsprint carrier system is characterized by eliminating the need for return to the newsprint manufacturer, increasing core crush resistance during shipping and storing, and reducing roll vibration during unwinding in the printing press.

BACKGROUND OF THE INVENTION

For the unwinding of newsprint from reels in printing presses, such as the widely used Goss Headliner Offset Printing Press, newsprint has been traditionally wound at the newsprint paper manufacturer onto elongate tubular cores to form rolls of newsprint. These newsprint rolls are often stored at the newsprint manufacturer, then shipped to the newspaper printer, often stored at the newspaper printer, and then mounted on stub shafts or chucks in reels of printing presses to be unwound and fed through the printing presses during the printing of newspapers.

The elongate tubular cores in early times were manufactured of wood and in later times have been manufactured of paper having a multi-ply spirally-wound construction. Metal end caps having a longitudinal groove therein have long been utilized on opposite end portions of the core, since early printing presses were axially driven and braked. The metal end caps reinforced the core ends to transmit axial torque and roll weight to the narrow shoulders of the outside surfaces of the printing press reel stub shafts or chucks. The metal end caps were also thought to reinforce the opposite end portions of the core against damage to the end portions of the core and the newsprint roll during storage and shipment.

Later printing presses became peripherally driven and braked and the demand for axial torque diminished; however, the requirement for weight support at the point of Contact of these metal end caps with the narrow shoulders of the stub shafts or chucks of the printing press reels increased over the years due to increased newsprint roll weights and increased newsprint unwinding speeds. The result of such increased newsprint roll weights and unwinding speeds was less effective control of the core in bouncing or vibrating on the reel stub shafts or chucks and thus causing undesirable vibration in the newsprint being unwound and fed into the printing presses.

The usual industry response to this problem, rather than redesign of the newsprint core, has heretofore been to build more sophisticated newsprint roll chucks or stub shafts including web vibration controls, such as air pressure chucks or stub shafts which increasingly "home in" on expiring rolls as the cores retract from the stub shafts or chucks due to deflection and vibration.

This type of newsprint cores having metal end caps did not allow for the cores to be non-returnable by the newspaper printers and the newspaper printers were requested to return all of these cores to the paper manufacturers for reuse in winding additional rolls of newsprint. This created handling problems both with the newspaper printer and with the paper manufacturer.

In recent times, there has been some attempt to provide non-returnable newsprint cores by eliminating the metal end caps on the cores. However, no significant redesign of the core construction was effected after removal of the metal end caps, other than to burnish or grind away a small flat portion at the opposite ends of the paper cores to provide for a contact area for the cores on the narrow shoulders of the outside surfaces of the printing press reel stub shafts or chucks, generally along the lines previously provided by the metal end caps. Due to the increased weight and unwinding speeds of the newsprint rolls, elimination of the metal end caps with this type of core was not found to be satisfactory by most newspaper printers and, thus, attempts at non-returnable newsprint cores have largely been unsuccessful.

As newsprint roll weights increased, damage to the end portions of the tubular core and the newsprint roll during shipping and storage increased. This often occurred as a result of impact on the outside circumference of the newsprint roll, particularly at the ends thereof. The result was that distortion to the metal end caps was duplicated on the inside surface thereof and the metal end caps could not ride up far enough on the shoulder of the printing press reel stub shafts and would consequently bounce and vibrate as the newsprint roll is unwound in the printing press.

Core plugs have been designed and utilized for being inserted into the end portions of the tubular core after winding of the newsprint roll and during shipping and storage to prevent damage to the end portion of the tubular core and to the newsprint roll. These core plugs were removed prior to mounting of the newsprint roll in the reels of the printing presses. Such core plugs were formed of a variety of types of materials, such as wood, plastic or other crush-resistant material. The most common core plugs utilized were generally cylindrical in shape and utilized a centrally located hole therethrough for the insertion of a tool therein to remove the core plug from the core after storage and shipping.

It was found that this centrally located hole for removal of the core plug from the core resulted in a weakened core plug which did not provide all of the core crush resistance desired. More recently, improvements to this construction of a core plug have been suggested, such as disclosed in U.S. Pat. No. 4,484,715, wherein the core plug includes an opening or grooves spaced from the center of thereof and near its remote outer edge for use in removal of the core plug from the core, while increasing crush resistance of the core plug. However, it has been found that this core plug construction with a groove at its outer edge, rather than a centrally located hole, may not provide sufficient core crush resistance in some instances.

OBJECTS AND SUMMARY OF THE INVENTION

It is, therefore, the object of this invention to provide a non-returnable newsprint carrier system adapted for winding of newsprint, shipping and storing of newsprint and mounting in reels of offset printing presses on stub shafts having a predetermined non-cylindrical outside configuration and profile for unwinding of newsprint, and which solves the above discussed problems in prior systems by eliminating the need for return of the core to the newsprint manufacturer, increasing core crush resistance during shipping and storing, and reducing roll vibration during unwinding in the printing press.

It has been found by this invention that the above object may be accomplished by providing a non-returnable newsprint carrier system including generally the following.

An elongate tubular core, preferably paper, of predetermined dimensions is provided for winding of newsprint thereon to form a roll of newsprint and which has opposite end portions without metal caps thereon for receiving therewithin on inside surfaces thereof the reel stub shafts to mount the roll of newsprint in the offset printing press. The inside surfaces of the opposite end portions of the tubular core have substantially the same non-cylindrical configuration, profile and dimensions as the outside surfaces of the reel stub shafts of the offset printing press so that the tubular core and the newsprint roll will have a full profile fit in surface-to-surface contact over substantially the entire surface area of the reel stub shafts received within the core, rather than only at the shoulder portion of the reel stub shafts as was previously the practice with metal ed caps, to reduce roll vibration during unwinding of the newsprint in the offset printing press. Also, the ends of a paper core without metal end caps will by its structure absorb impact on its outside circumference without transmitting the distortion to the inside profile so that the core will still spin dynamically on the printing press reel stub shafts without vibration.

Core plugs are provided for being inserted into the end portions of the tubular core after winding of the newsprint roll and during shipping and storage to prevent damage to the end portions of the tubular core and to the newsprint roll. Each of the core plugs comprises a solid body without holes or grooves therein, having a generally circular cross-sectional configuration, being formed of wood, plastic or the like crush resistant material. Each of the core plugs has an outside surface area of substantially the same non-cylindrical configuration, profile and dimensions as the outside surface of the reel stub shafts of the offset printing press and the inside surfaces of the opposite end portions of the tubular core for being positioned therewithin. Each of the core plugs further includes a circumferential lip area at the end of the core plug for being positioned at the end of the tubular core for suitable engagement or gripping to remove the core plugs from the tubular core.

Thus, the newprint carrier system of this invention has been designed to be non-returnable by eliminating the previously utilized metal end caps which were generally considered necessary in the industry. The inside surfaces of the opposite end portions of the core and the outside surface of the core plug have been designed to have substantially the same dimensions, configuration and profile as the portion of the stub shafts or chucks of the reels of the offset printing presses which are received within the opposite end portions of the newsprint roll core. This construction provides a full profile fit in surface-to-surface contact over substantially the entire surface area of the reel stub shafts received within the core and the inside surfaces of the opposite end portions of the core to reduce by vibration during unwinding of the newsprint in the offset printing press and to provide additional support allowing the elimination of the metal end caps. The core plugs have also eliminated the undesirable holes or grooves heretofore utilized therein for removal thereof from the opposite end portions of the newsprint roll core to increase core crush resistence. The core plugs provide a lip on the outside ends for suitable engagement or gripping by a tool or the like to remove the core plugs from the newsprint roll core.

Therefore, for the first time, a non-returnable newsprint carrier system has been designed which is specifically adapted to fit the non-cylindrical profile and configuration of the stub shafts or creels of the printing presses without the need for any modifications to the printing presses to eliminate all of the problems previously encountered with such systems.

BRIEF DESCRIPTION OF THE DRAWINGS

Some of the objects and advantages of this invention have been set forth above, other objects and advantages will become apparent as the description proceeds when taken in conjunction with the accompanying drawings, in which.

DETAILED DESCRIPTION OF PREFERRED EMBODIMENT OF THE INVENTION

Figure 1:
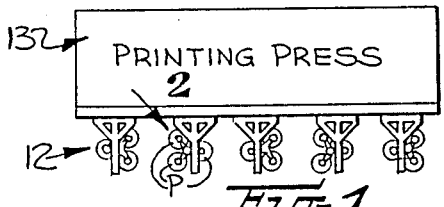
FIG. 1 is a schematic illustration of a printing press in which newsprint rolls utilizing the carrier system of this invention are mounted.
Figure 2:
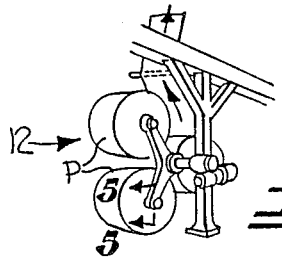
FIG. 2 is a perspective detail, taken generally in the direction of Arrow 2 in FIG. 1, of one of the reel mechanisms utilized in the printing press of FIG. 1.
Figure 3:
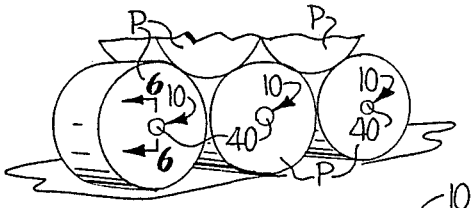
FIG. 3 is a partial, perspective view illustrating wound newsprint rolls utilizing the carrier system of this invention and in the storage condition thereof.
Figure 4:
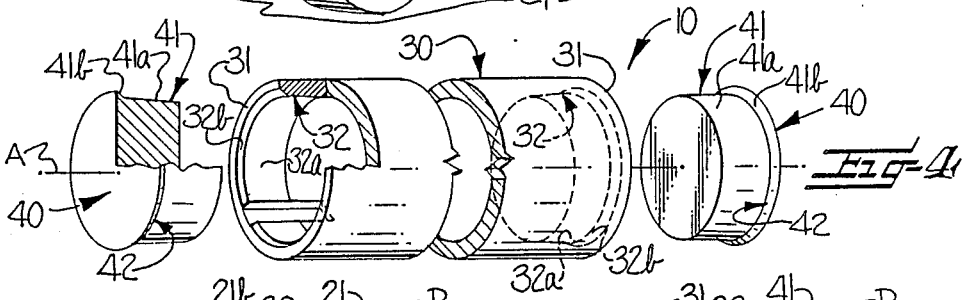
FIG. 4 is a perspective exploded view broken away and partly in section, of the newsprint carrier system of this invention.
Figure 5:
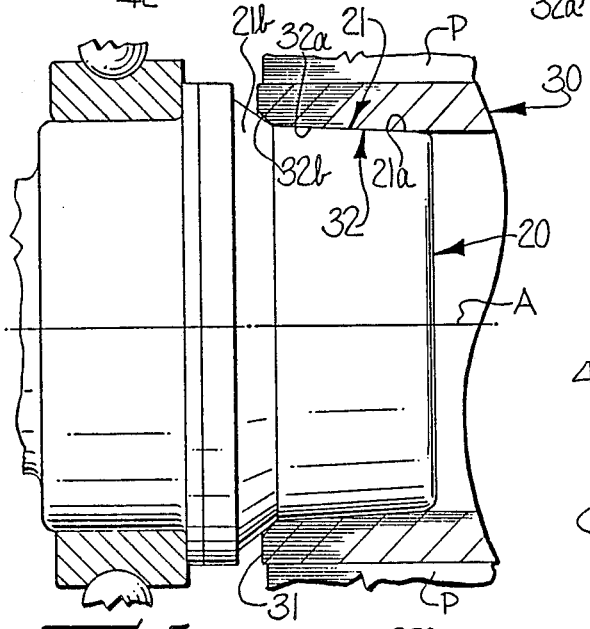
FIG. 5 is a sectional view, taken generally along the lines 5—5 of FIG. 2, illustrating the newsprint roll and core mounted on a stub shaft of the printing press reel.

Referring now to the drawings, a non-returnable newsprint carrier system, generally designated at 10, is illustrated for winding of newsprint P into rolls (FIG. 3), shipping and storing of the newsprint (FIG. 3) and mounting in reels 12 of a printing press 13 (FIGS. 1 and 2) on stub shafts or chucks 20 having a predetermined outside non-cylindrical configuration and profile (FIG. 5) for unwinding of the newsprint P. The printing press 13 including reels 12 are well understood by those with ordinary skill in the art and further description or illustration thereof is not believed necessary herein for a full understanding of the present invention.

Figure 7:
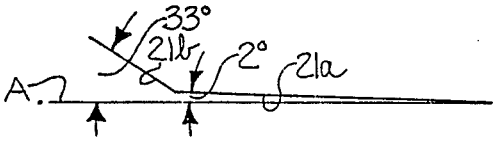
FIG. 7 is a schematic view illustrating the angles of the portions of the surfaces the respective inside of the opposite ends of the core and the outside of the core plug the printing press reel stub shafts with respect to a longitudinal central axis.

The stub shafts or chucks 20 (FIG. 5) have a generally circular cross-section and conventionally include a newsprint roll receiving outside surface 21 (FIG. 7) which is non-cylindrical and which includes a first portion **21*a* extending inwardly from the outer end thereof and which tapers radially outwardly at a first predetermined angle, preferably about 2°, with respect to a longitudinal central axis A (FIGS. 5 and 7) and a second portion 21*b*** extending inwardly from the first portion 21*a* and tapering outwardly at a second predetermined angle, preferably approximately 33°, with respect to the longitudinal axis A (FIGS. 5 and 7) and which is greater than the first angle of portion 21*a*.

The non-returnable newsprint carrier system 10, in accordance with this invention, comprises firstly an elongate tubular core 30 of predetermined dimensions for winding of the newsprint P thereon to form a roll of newsprint P. The core 30 has opposite end portions 31 without metal end caps thereon and defining inside surfaces 32 for receiving therewithin the reel stub shafts 20 (FIG. 5) to mount the roll of newsprint P in the reel 12 of the offset printing press 13. The inside surfaces 32 of the opposite end portions 31 of the tubular core 30 have substantially the same non-cylindrical configuration, profile and dimensions as the portion of the outside surface 21 of the reel stub shafts 20, described above, received therein so that the tubular core 30 will have a full profile fit in surface-to-surface contact over substantially the entire surface area 21 of the reel stub shafts 14 received within the core 30 (FIG. 5) to reduce roll vibration during unwinding of the newsprint P in the offset printing press 13.

Specifically, the inside surfaces 32 of the opposite end portions 31 of the tubular core 30 include a first portion 32*a* extending outwardly toward the ends of the core 30 and tapering radially outwardly at a first predetermined angle (preferably approximately 2°, with respect to the longitudinal central axis A and a second portion 32*b* extending outwardly from the first portion 32*a* to the end of the core 30 and tapering radially outwardly at a second predetermined angle, preferably approximately 33°, with respect to the longitudinal central axis A and which is greater than the first angle for receiving therewithin the reel stub shafts 20 of substantially the same configuration and profile.

The tubular core 30 preferably comprises a multi-ply spirally-wound paper tube and the first and second portions 32*a*, 32*b* of the inside surfaces 32 of the opposite end portions 31 of the tubular core 30 comprise burnished or ground away areas.

Figure 6:
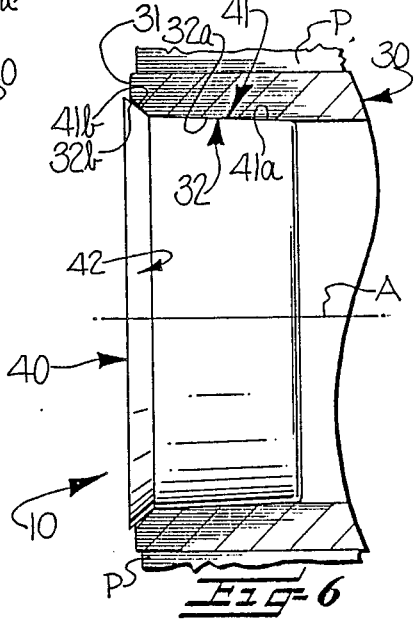
FIG. 6 is a cross sectional view, taken generally along the lines 6—6 of FIG. 3, illustrating a core plug inserted into one of the opposite ends of the newsprint roll core in accordance with this invention.

The non-returnable newsprint carrier system 10 further includes core plugs 40 for being inserted into the opposite end portions 31 of the tubular core 30 after winding of the roll of newsprint P and during shipping and storage to prevent damage to the end portions 31 of the tubular core 30 and to the roll of newsprint P. Each of the core plugs 40 comprises a solid body without holes or grooves therein, having a generally circular cross-sectional configuration, and being formed of wood, plastic or the like crush-resistant material, preferably molded high density wood. The core plugs 40 each have an outside surface area 41 of substantially the same non-cylindrical configuration, profile and dimensions as the outside surface 21 of the reel stub shafts 20 of the offset printing press 13 and the inside surface 32 of the opposite end portions 31 of the tubular core 30 for being positioned therewithin. Each of the core plugs 40 further includes a circumference lip area 42 at the end of the core plug 40 for being positioned at the end of the tubular core 30 (FIG. 6) for suitable engagement or gripping to remove the core plugs 40 from the tubular core 30.

Specifically, the first outside surface area 41 of the core plug includes a first portion 41*a* adapted to extend outwardly toward the ends of the core 30 from the inside thereof and tapering radially outwardly at a first predetermined angle, preferably approximately 2°, with respect to the longitudinal central axis A and a second portion 41*b* extending outwardly from the first portion toward the ends of the core 30 and tapering radially outwardly at a second predetermined angle, preferably approximately 33°, with respect to a longitudinal central axis A and which is greater than the first angle.

In the drawings and specification there has been set forth a preferred embodiment of this invention and although specific terms are employed, they are used in a generic and descriptive sense only and not for purposes of limitation, the scope of the invention being defined in the following claims.

What is claimed is:

1. A non-returnable newsprint carrier system adapted for winding of newsprint, shipping and storing of newsprint and mounting in reels of offset printing presses on stub shafts having a predetermined non-cylindrical outside surface configuration and profile for unwinding of newsprint, and characterized by eliminating the need for return to the newsprint manufacturer, increasing core crush resistance during shipping and storing, and reducing roll vibration during unwinding in the printing press; said system comprising:

an elongate tubular core of predetermined dimensions for winding of newsprint thereon to form a roll of newsprint and having opposite end portions without metal end caps thereon and defining inside surfaces for receiving therewithin the reel stub shafts to mount the roll of newsprint in the offset printing press, said inside surfaces of said opposite end portions of said tubular core having predetermined non-cylindrical configuration, profile and dimensions for being adapted to be mounted on complementary portions of the outside surfaces of the reel stub shafts of the offset printing press so that said tubular core will be adapted to have a full profile fit in surface-to-surface contact over substantially the entire surface area of the reel stub shafts received within said core, said non-cylindrical configuration comprising means for reducing roll vibration during unwinding of the newsprint in the offset printing press; and core plugs for being inserted into the end portions of said tubular core after winding of the newsprint roll and during shipping and storage to prevent damage to the end portions of said tubular core and to the newsprint roll, each of said core plugs comprising a solid body without holes or grooves therein, having a generally circular cross-sectional configuration, being formed of wood, plastic or the like crush-resistant material, and having an outside surface area of substantially the same non-cylindrical configuration, profile and dimensions as said inside surfaces of said opposite end portions of said tubular core for being positioned therewithin and a circumferential lip area at the end of said tubular core for suitable engagement or gripping to remove said core plugs from said tubular core.

2. A non-returnable newsprint carrier system, as set forth in claim 1, wherein said tubular core comprises a multi-ply spirally-wound paper tube.

3. A non-returnable newsprint carrier system, as set forth in claim 1, wherein said core plugs comprise molded high density wood.

4. A non-returnable newsprint carrier system, as set forth in claim 1, wherein said inside surfaces of said opposite end portions of said tubular core include a first portion extending outwardly toward the ends of said core and tapering radially outwardly at a first predetermined angle with respect to a longitudinal central axis and a second portion extending outwardly from said first portion to the ends of said core and tapering radially outwardly at a second predetermined angle with respect to a longitudinal central axis which is greater than the first angle for receiving therewithin the reel stub shafts of substantially the same configuration and profile; and wherein said outside surface area of said core plugs comprises substantially the same first and second surface portions as said inside surfaces of said opposite end portions of said tubular core.

5. A non-returnable newsprint carrier system, as set forth in claim 4, wherein said tubular core comprises a multi-ply spirally-wound paper tube.

6. A non-returnable newsprint carrier system, as set forth in claim 4, wherein said core plugs comprise molded high density wood.

7. A non-returnable newsprint carrier system, as set forth in claim 4, wherein said tubular core comprises a multi-ply spirally-wound paper tube and said first and second portions of said inside surfaces of said opposite end portions of said tubular core comprises burnished areas.

8. A non-returnable newsprint carrier system, as set forth in claim 7, wherein said core plugs comprise molded high density wood.

9. A core plug adapted for being inserted into opposite end portions of a tubular carrier core of a newsprint roll having predetermined non-cylindrical inside surfaces to prevent damage to the end portions of the tubular core and newsprint roll during shipping and storing, and characterized by increased crush-resistance by eliminating the need for holes or grooves heretofore utilized for removal of said core plug from the tubular core; said core plug comprising a solid body without holes or grooves therein, having a generally circular cross-sectional configuration, being formed of wood, plastic or the like crush-resistant material, and having an outside surface area of predetermined non-cylindrical configuration, profile and dimensions for being adapted to be positioned within complimentary inside surfaces of the opposite end portions of the tubular core and a circumferential lip area at the end of said core plug adapted to be positioned at the end of the tubular core for suitable engagement or gripping to remove said core plug from the tubular core, and wherein said outside surface area of said core plug includes a first portion adapted to extend outwardly toward the ends of said core and tapering radially outwardly at a first predetermined angle with respect to a longitudinal central axis and a second portion extending outwardly from said first portion and tapering radially outwardly at a second predetermined angle with respect to a longitudinal central axis which is greater than the first angle.

10. A non-returnable newsprint core adapted for the winding of newsprint thereon to form a roll and adapted to be mounted on stub shafts of a predetermined non-cylindrical outside configuration and profile in reels of offset printing presses for unwinding the newsprint in the printing press, and characterized by elimination the need for return to the newsprint manufacturer and reducing roll vibration during unwinding in the printing press; said core comprising an elongate tube of predetermined dimensions and having opposite end portions without metal end caps thereon and defining inside surfaces for receiving therewithin the reel stub shafts to mount the roll of newsprint in the offset printing press, said inside surfaces of said opposite end portions of said tubular core having predetermined non-cylindrical configuration, profile and dimensions for being adapted to be mounted on complimentary portions of outside surfaces of the reel stub shafts of the offset printing press so that said tubular core and the newsprint roll will be adapted to have a full profile fit in surface-to-surface contact over substantially the entire surface area of the reel stub shafts received within said core to reduce roll vibration during unwinding of the newsprint in the offset printing press, and wherein said inside surfaces of said opposite end portions of said tubular core include a first portion extending outwardly toward the ends of said core and tapering outwardly at a first predetermined angle with respect to a longitudinal central axis and a second portion extending outwardly from said first portion to the ends of said core and tapering radially outwardly at a second predetermined angle with respect to a longitudinal central axis which is greater than the first angle for being adapted to receive therewithin the reel stub shafts of substantially the same configuration and profile.

11. A non-returnable newsprint core, as set forth in claim 10, wherein said tubular core comprises a multi-ply spirally-wound paper tube.

12. A non-returnable newsprint core, as set forth in claim 10, wherein said tubular core comprises a multi-ply spirally-wound paper tube and said first and second portions of said inside surfaces of said opposite end portions of said tubular core comprises burnished areas.

* * * * *

UNITED STATES PATENT AND TRADEMARK OFFICE

CERTIFICATE OF CORRECTION

PATENT NO. : 4,875,636

DATED : October 24, 1989

INVENTOR(S) : Daniel D. Kewin

It is certified that error appears in the above-identified patent and that said Letters Patent is hereby corrected as shown below:

On the title page:

References Cited:

Delete "888,860 2/1908 Burns"

Add:

- - Foreign Patent Documents
888,860 2/62 Burns --.

Column 1, line 47, "Contact" should be -- contact --.

Column 3, line 23, "ed" should be -- end --.

Column 8, line 11, "elimination" should be -- eliminating --.

Signed and Sealed this

Twenty-fifth Day of September, 1990

*Attest:*

HARRY F. MANBECK, JR.

*Attesting Officer*

*Commissioner of Patents and Trademarks*